US005660014A

United States Patent [19]

Stahl et al.

[11] Patent Number: 5,660,014

[45] Date of Patent: Aug. 26, 1997

[54] COMPOSITE SHINGLE HAVING SHADING ZONES IN DIFFERENT PLANES

[75] Inventors: Kermit E. Stahl, North Wales; Michael J. Noone, Wayne; George W. Mehrer, Jenkintown, all of Pa.

[73] Assignee: CertainTeed Corporation, Valley Forge, Pa.

[21] Appl. No.: 386,953

[22] Filed: Feb. 10, 1995

Related U.S. Application Data

[63] Continuation of Ser. No. 712,965, Jun. 10, 1991, Pat. No. 5,426,902, and a continuation-in-part of Ser. No. 570,722, Aug. 20, 1990, which is a division of Ser. No. 174,022, Mar. 29, 1988, said Ser. No. 712,965, is a continuation-in-part of Ser. No. 515,253, Apr. 27, 1990, Pat. No. Des. 340,294, Ser. No. 515,258, Apr. 27, 1990, Pat. No. Des. 336,347, and Ser. No. 515,601, Apr. 27, 1990, Pat. No. 5,181,361, each is a continuation-in-part of Ser. No.110,801, Oct. 20, 1987, Pat. No. Des. 314,628, and a continuation-in-part of Ser. No. 174,023, Feb. 28, 1988.

[51] Int. Cl.[6] ..... E04D 5/10

[52] U.S. Cl. ..... 521/314; 52/316; 52/555; 52/557; 52/558; 52/559; D25/139

[58] Field of Search ..... 52/311.1, 314, 52/316, 518, 535, 540, 554, 557, 558, 559, 555; D25/139

[56] References Cited

U.S. PATENT DOCUMENTS

| | | | |
|---|---|---|---|
| D. 48,172 | 11/1915 | DunLany . | |
| D. 51,438 | 10/1917 | Caron . | |
| D. 83,704 | 3/1931 | Stark . | |
| D. 313,278 | 12/1990 | Noone | D25/139 |
| D. 313,658 | 1/1991 | Noone | D25/139 |
| D. 314,439 | 2/1991 | Jenkins et al. | D25/139 |
| D. 314,628 | 2/1991 | Jenkins et al. | D25/139 |
| D. 317,506 | 6/1991 | Jenkins et al. | D25/139 |
| D. 326,330 | 5/1992 | Klein | D25/139 |
| D. 336,347 | 6/1993 | Hannah et al. | D25/139 |
| D. 340,294 | 10/1993 | Hannah et al. | D25/139 |
| D. 344,144 | 2/1994 | Weaver et al. | D25/139 |
| D. 350,615 | 9/1994 | Klein | D25/139 |
| 1,154,334 | 9/1915 | Overbury . | |
| 1,208,595 | 12/1916 | McKay . | |
| 1,345,627 | 7/1920 | Overbury . | |
| 1,351,181 | 8/1920 | McKay . | |
| 1,368,947 | 2/1921 | Levis . | |
| 1,583,563 | 5/1926 | Abraham . | |
| 1,593,095 | 7/1926 | Munro . | |
| 1,601,731 | 10/1926 | Flood . | |
| 1,629,287 | 5/1927 | Milligan . | |
| 1,748,981 | 3/1930 | Harris . | |
| 1,791,571 | 2/1931 | Overbury . | |
| 1,802,868 | 4/1931 | Black . | |
| 1,873,944 | 8/1932 | Black . | |
| 1,898,989 | 2/1933 | Harshberger . | |
| 1,924,650 | 8/1933 | Payne . | |
| 1,958,560 | 5/1934 | Beckman . | |
| 2,045,423 | 6/1936 | Topping . | |
| 2,085,899 | 7/1937 | Chamberlain . | |
| 2,096,968 | 10/1937 | Johnson . | |
| 2,196,847 | 4/1940 | Austin . | |
| 2,197,972 | 4/1940 | Ernst . | |
| 2,199,760 | 5/1940 | Schuetz . | |

(List continued on next page.)

*Primary Examiner*—Robert Canfield
*Attorney, Agent, or Firm*—Paul & Paul

[57] ABSTRACT

A laminated shingle is provided, having lighter and darker granule portions visible from the front, at different planes; the front-most or anterior plane generally having granules of lighter shading and the more rearward or posterior plane generally having darker granules. The darker granules in the more posterior plane are visible from the front of the shingle to provide visually sharp, precise delineation between zones of lighter and darker shading. The shingles may be of multi-layer construction with suitable adhesives securing the layers together. The darker granules may be visible from beneath the lower edge(s) of the anterior shingle, to provide a shadow line effect. Alternatively, or in addition thereto, the darker shingle zones from the more posterior plane may be visible through tab-separating slots of the lighter shaded anterior shingle portion.

1 Claim, 2 Drawing Sheets

U.S. PATENT DOCUMENTS

| | | | |
|---|---|---|---|
| 2,205,679 | 6/1940 | Ames . | |
| 2,206,915 | 7/1940 | Ochs . | |
| 2,253,652 | 8/1941 | Ritter . | |
| 2,335,493 | 11/1943 | Drinkall . | |
| 2,661,303 | 12/1953 | Fasold . | |
| 3,166,872 | 1/1965 | Cacossa . | |
| 3,377,762 | 4/1968 | Chalmers et al. . | |
| 3,468,092 | 9/1969 | Chalmers et al. . | |
| 3,484,267 | 12/1969 | Sadler . | |
| 3,613,328 | 10/1971 | Morgan et al. . | |
| 3,624,975 | 12/1971 | Morgan et al. . | |
| 3,919,823 | 11/1975 | Bradley . | |
| 3,921,358 | 11/1975 | Bettoli . | |
| 4,274,243 | 6/1981 | Corbin et al. | 52/557 X |
| 4,322,928 | 4/1982 | Freiborg | 52/521 |
| 4,468,909 | 9/1984 | Eaton . | |
| 5,181,361 | 1/1993 | Hannah et al. | 52/535 |
| 5,375,387 | 12/1994 | Davenport | 52/537 |
| 5,426,902 | 6/1995 | Stahl et al. | 52/314 |

COMPOSITE SHINGLE HAVING SHADING ZONES IN DIFFERENT PLANES

CROSS-REFERENCE TO RELATED APPLICATIONS

This is a continuation of application Ser. No. 712,965, filed Jun. 10, 1991, now U.S. Pat. No. 5,426,902 which is a continuation-in-part of design application Ser. Nos. 515,253: 515,258; and utility application Ser. No. 515,601, all filed Apr. 27, 1990 and all of which, in turn, are continuations-in-part of design application Ser. No. 110,801 filed Oct. 20, 1987, now U.S. Pat. No. Des. 314,628 and of design application Ser. No. 174,023 filed Mar. 28, 1988. This is also a continuation-in-part of design application Ser. No. 570,722 filed Aug. 20, 1990, which, in turn, is a division of design application Ser. No. 174,022 filed Mar. 29, 1988.

SUMMARY OF THE INVENTION

A composite, laminated shingle is provided having layers of granules at different planes, with the granules in the more posterior plane being darker than those in the more anterior plane, to yield zones of different shading. The edges of the granules in the anterior plane, which are on a different shingle layer than those of the granules in the posterior plane, provide visually sharp; precise delineation between zones of lighter and darker shadings. The darker shadings may preferably be provided below the lower edges of the shingle layer having the lighter granules, and/or through tab-separating slots in such anterior shingle layer.

BACKGROUND OF THE INVENTION

The present invention is directed to a multi-layer shingle preferably one constructed of asphaltic roofing material, and most particularly one having an asphaltic material provided over a base mat, which then has granules applied to surfaces thereof.

The art of shingle manufacture is highly developed, and improvements in shingle manufacturing have been subtle, often being devoted to the simulation of wood or other natural appearing shingles, having natural appearing textures.

In the course of shingle development, some approaches have been toward applying granules of various color and shading configurations.

The present invention is directed toward providing a multi-layer shingle, of at least two layers, having areas of different shading, at different depths or planes, whereby the visual contrast, upon viewing a shingle from the front, is of sharp, precise delineation between the zones caused by edges of the anterior shingle layer of one shading overlying portions of a posterior shingle layer of a different shading.

Accordingly, it is a primary object of this invention to provide a multi-layer shingle having sharp, precise delineation between zones of different shadings.

It is another object of this invention to accomplish the above object, by the use of anterior and posterior shingle layers having granules of different shadings in different planes.

Other objects and advantages of the present invention will be readily apparent to those skilled in the art from a reading of the following brief descriptions of the drawing figures, detailed descriptions of the preferred embodiments and the appended claims.

BRIEF DESCRIPTIONS OF THE DRAWING FIGURES

DETAILED DESCRIPTIONS OF THE PREFERRED EMBODIMENTS

Figure 1:
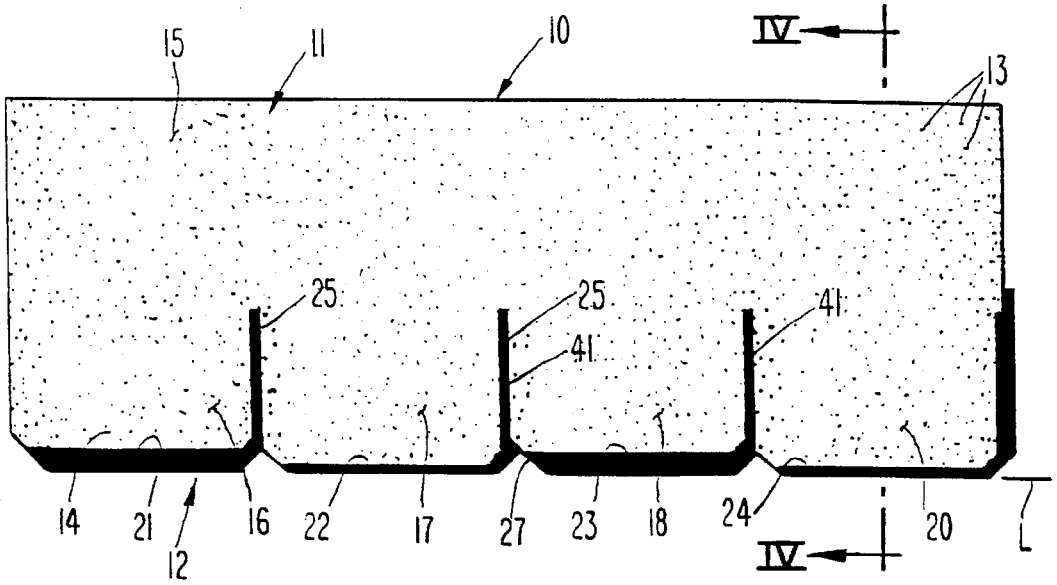
FIG. 1 is a front view of a composite shingle in accordance with this invention.

Referring now to the drawings in detail, reference is first made to FIG. 1, wherein a shingle, generally designated by the numeral 10, is shown. The shingle 10 comprises an anterior layer 11 and a posterior layer 12, secured together by a suitable adhesive substance, located therebetween. The anterior layer 11, or the layer which is viewed principally from the front when the shingle is in an installed condition, is comprised of a suitable mat of fiberglass or other construction that is permeated with a preferably asphaltic substance, and with a plurality of granules 13 dispersed over the front surface 14, and held thereagainst by the adhesive characteristics of the asphalt comprising the surface 14 beneath the granules 13. The shingle layer 11 has an upper portion 15 and a plurality of tab portions 16, 17, 18 and 20. The tab portions 16, 17, 18 and 20 are shown having different levels of downward extension for their lower edges 21–24, respectively, but it will be understood that shingle tabs may vary in this respect, to have a common lower edge, different shapes for their lower edges, or all be identical and at different levels of extension, as may be desired. Where the shingle layer is to be divided into tabs, there will generally be one or more slots 25 extending completely through the anterior layer 11, as shown. The lower ends of the shingles may have suitable aesthetic indentations or notches such as that 27, as may be desired.

The lower edge of the posterior layer 12, to which the granule layer 33 extends, defines a straight line "L", although the line L may be interrupted by interruptions therein, such as the notches 27. The straight edge formed by the line L provides a number of advantages. One such advantage is in the application of shingles to a roof, where the workman applying the shingle may utilize the generally straight line L as a guide in applying the shingles in a straight line, one next to the other, and even in applying successive courses, one over the other. Another advantage of the straight line L resides in facilitating packaging of shingles, wherein stacks of shingles will have a generally common edge, for vertically aligning shingles in a stack. A third advantage resides in the ability to have the anterior layer 11 assume various diverse configurations at its lower end, yet remain protected, because the lower edge of the anterior layer is set back, or above the lower edge of the posterior layer that provides the protection.

Figure 2:
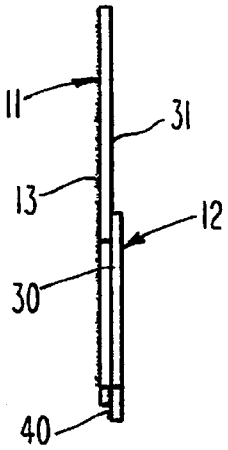
FIG. 2 is a right end view of the shingle of FIG. 1.

With reference as well to FIG. 2, it will be seen that the posterior layer 12 may be of substantially half height, as shown, to be disposed such that its front surface is against the rear surface 31 of the anterior layer 11, as shown.

Figure 4:
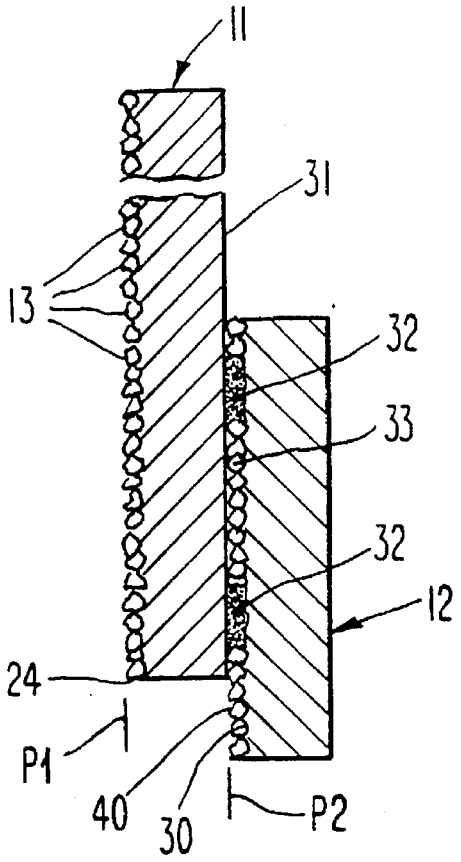
FIG. 4 is an enlarged fragmentary, schematic, cross-sectional view of the shingle of FIG. 1 taken generally along the line IV—IV of FIG. 1.

With specific reference to FIG. 4, it will be seen that a plurality of adhesive strips 32 are provided, embedded in the granule layer 33 that is on the front surface of the posterior layer 12, connecting the front surface 30 of posterior layer 12 to the rear surface 31 of the anterior layer 11, in an adhesive-secured manner. The adhesive strips 33 are also preferably constructed of an asphaltic substance.

Figure 6:
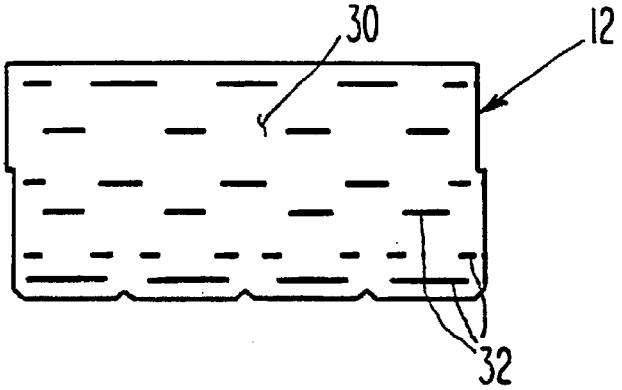
FIG. 6 is a schematic view of a posterior shingle layer, with zones of adhesive application.

With specific reference to FIG. 6, there is shown a pattern of arrangement for adhesive strips 32, on the front surface 30 of the posterior layer 12.

With specific reference to FIG. 4, it will be seen that the granule layers 13 and 33 are disposed at different spaced-apart planes P1 and P2, respectively.

It will also be apparent that the darker granule zones such as those 40 extending below and visible beneath a lower tab edge 24 of the anterior layer 11, as well as those 41 visible through slots 25, are uncovered by the anterior shingle layer 11 such that the darker granules disposed thereon are seen in marked contrast to the lighter granules 15 on the front surface of the anterior layer 11, such that the edges of the slots 25 in the anterior layer, and the edges 21, 22, 23 and 24 at the lower ends of the tabs form a visually sharp, precise delineation between zones of lighter and darker shadings. It will be apparent that, while only two different shading zones are shown in the illustration of FIG. 1; one lighter and one darker, various modifications and arrangements may be made. For example, on the front surface of the layer 11, a plurality of different lighter shading zones may be utilized. Similarly, on the front surface of the posterior layer 12, a plurality of different darker shading zones maybe utilized. In lieu of different levels of lightness or darkness of the various shading zones discussed, or in addition thereto, the various shading zones may simply be zones of different colors, all within the spirit and scope of this invention.

It will also be apparent that the granules may be of different types and selections, to yield different shading, sizing, and/or color arrangements.

Figure 3:
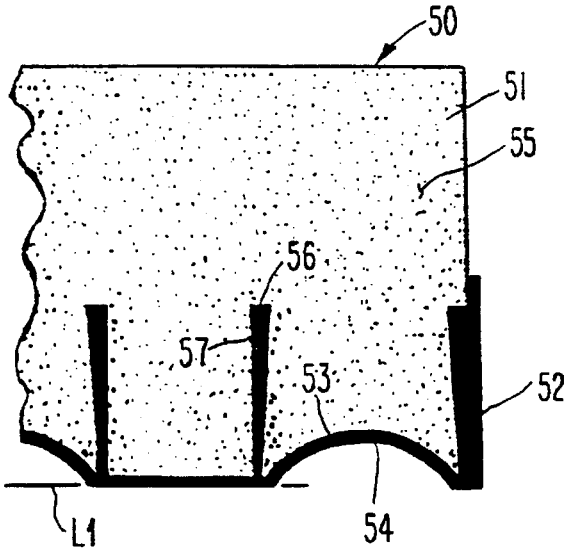
FIG. 3 is a fragmentary view of an alternative embodiment of a shingle in accordance with this invention, in which the zones of darker shading have a different configuration than the zones of darker configuration for the shingle of FIG. 1.

With reference to FIG. 3, it will be seen that a representative alternative design may be made, utilizing a shingle 50 having an anterior layer 51 and a posterior layer wherein the lower edge 53 of the anterior layer has a particular design configuration, beneath which is visible a particular design configuration for the darker edge extension of the layer 52, and at a plane spaced-apart from the front surface 55 of the anterior layer 51, in much the same manner as the relative spacings of planes P1 and P2 of FIG. 4. Similarly, the visibility of portions of a darker layer of granules 56 from the front surface of posterior layer 52 is apparent through the slots 57, configured in a different arrangement for the embodiment of FIG. 3. The lower edge of the posterior layer of the shingle of FIG. 3 terminates in a straight line L1 for the same reasons as are set forth above for the shingle of FIG. 1, although the same may be interrupted as shown or in any other design.

Figure 5:
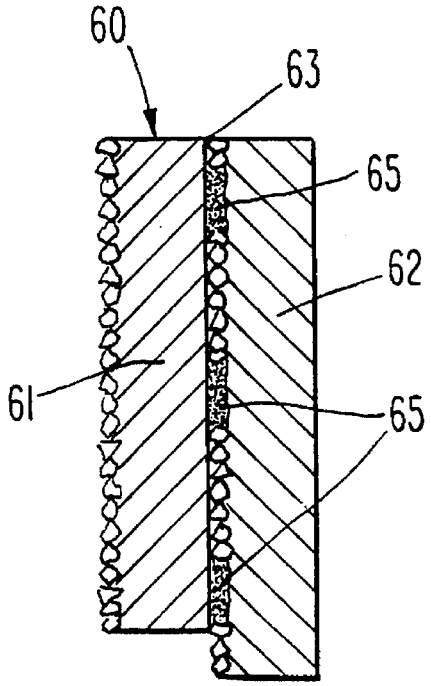
FIG. 5 is a view similar to that of FIG. 4, but wherein the posterior shingle layer is of full height.

With specific reference to FIG. 5, there is shown another alternative embodiment for a shingle 60, in which an anterior layer 61 has a posterior layer 62 that is of such a height that it substantially covers all of the rear surface 63 of the layer 62, as shown, being suitably secured thereto by adhesive zones 65, similar to those discussed above with reference to the embodiment of FIG. 4.

It will be apparent from the foregoing that various modifications may be made in the details of construction, as well as in the use and operation of the present invention all within the spirit and scope of the invention as claimed.

What is claimed is:

1. A composite laminated, multiple-tab shingle of separate shingle layers for roofing or the like, comprising:

(a) an anterior shingle layer having front and rear surfaces, in planes, between edges thereof, with the front surface having a layer of granules thereon: said anterior shingle layer having at least a plurality of visible tab portions of a first, lighter shading;

(b) a posterior shingle layer having front and rear surfaces, in planes, between edges thereof;

(c) substantial portions of the front surface of said posterior shingle layer being covered by the anterior shingle layer;

(d) the posterior shingle layer also having visible front surface tab portions that are uncovered by the anterior shingle layer;

(e) the visible front surface portions of the posterior shingle layer being at a posterior plane relative to the plane of the front surface of the anterior shingle layer and having a layer of granules thereon; said posterior shingle layer having at least one visible front surface portion of a second, darker shading than said first shading, with edges of said anterior shingle layer comprising visually sharp, precise lines of delineation between portions of lighter and darker shadings;

(f) means between the shingle layers, securing the layers together; wherein the shingle layers each have upper and lower edges, and wherein the the visible front surface portion of the posterior shingle layer extends below a lowermost edge of a tab portion of the anterior shingle layer.

* * * * *